US011643810B2

(12) United States Patent
Wilson et al.

(10) Patent No.: US 11,643,810 B2
(45) Date of Patent: May 9, 2023

(54) LOOSE-FILL INSULATED BUILDING STRUCTURES AND METHODS FOR MAKING THEM

(71) Applicant: CertainTeed LLC, Malvern, PA (US)

(72) Inventors: Jonathan Wilson, Northboro, MA (US); Michael J. Lembo, Souderton, PA (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 17/354,502

(22) Filed: Jun. 22, 2021

(65) Prior Publication Data

US 2022/0049493 A1 Feb. 17, 2022

Related U.S. Application Data

(60) Provisional application No. 63/064,964, filed on Aug. 13, 2020.

(51) Int. Cl.
*E04B 1/76* (2006.01)

(52) U.S. Cl.
CPC ..... *E04B 1/7658* (2013.01); *E04B 1/7604* (2013.01)

(58) Field of Classification Search
CPC ..... E04B 1/7658; E04B 1/7604
See application file for complete search history.

(56) References Cited

U.S. PATENT DOCUMENTS

| | | | | |
|---|---|---|---|---|
| 2,131,620 | A * | 9/1938 | Garrison | E04B 1/7658 52/645 |
| 4,829,738 | A * | 5/1989 | Moss | E04B 1/7604 52/404.3 |
| 2005/0188649 | A1 | 9/2005 | Hagen | |
| 2007/0074474 | A1* | 4/2007 | Jannelle | E04B 1/7604 52/309.4 |
| 2017/0080614 | A1* | 3/2017 | Lamm | E04B 1/7604 |
| 2018/0030720 | A1 | 2/2018 | Parsons | |
| 2022/0049493 | A1* | 2/2022 | Wilson | E04B 1/80 |

FOREIGN PATENT DOCUMENTS

| | | |
|---|---|---|
| CN | 105926833 | 9/2016 |
| EP | 1323876 | 7/2003 |
| JP | 2001-003469 | 1/2001 |

OTHER PUBLICATIONS

International Search Report and Written Opinion in PCT/US2021/038432, dated Oct. 15, 2021.

* cited by examiner

*Primary Examiner* — Andrew J Triggs
(74) *Attorney, Agent, or Firm* — McDonnell Boehnen Hulbert & Bergoff LLP

(57) ABSTRACT

The present disclosure relates to insulated building structures. In one aspect of the disclosure, an insulated building structure includes a longitudinally-extending cavity bound by a first lateral surface, a second lateral surface, a back surface and a front surface, the cavity having a cross-sectional area in a plane normal to a longitudinal axis of the cavity; one or more shelves extending into the cavity, each having an occluded area in the plane that is less than the cross-sectional area of the cavity; and loose-fill insulation disposed in the cavity, loose-fill insulation being positioned above and below each of the shelves.

23 Claims, 9 Drawing Sheets

LOOSE-FILL INSULATED BUILDING STRUCTURES AND METHODS FOR MAKING THEM

CROSS-REFERENCE TO RELATED APPLICATIONS

This application claims the benefit of priority of U.S. Provisional Patent Application No. 63/064,964, filed Aug. 13, 2020, which is hereby incorporated herein by reference in its entirety.

1. FIELD OF THE DISCLOSURE

The present disclosure relates generally to systems and methods for supporting loose-fill insulation, such as blown-in insulation, to reduce settling thereof.

2. TECHNICAL BACKGROUND

Insulation materials such as fiberglass batts, rolls, blankets, or blown-in insulation are typically used to reduce the rate of heat transfer between two areas separated by a boundary. For example, in an attic, insulation material can be applied to the interior surface of the roof deck to slow the transfer of heat through the roof deck, that is, from the exterior of the house to the attic or vice versa. In another application, insulation material is applied to exterior walls (e.g., between wood studs) and covered with wallboards to slow the rate of heat transfer through the exterior wall and the wallboard. Insulation material can also prevent undesirable air movement (e.g., convection drafts) and resultant movement of moisture from one space to another.

Some of these forms of insulation, such as blown-in insulation, use a loose-fill material to fill the wall cavities. This loose-fill insulation can be quickly installed in walls and ceilings, and can be installed into wall cavities through small holes in the wall. However, over time the weight of the loose-fill insulation can cause the insulation to compress and settle. This settling can result in there being different amounts of insulation in various parts of the wall. In some cases, the settling could be severe enough to cause voids or gaps between the outside and inside surfaces of the cavity, where there would be no insulation present at all. But even in cases where no actual voids or gaps are present, reduced amounts of insulation in certain parts of a wall can cause undesirable heat loss through the wall.

Accordingly, what are needed are improved methods and systems for supporting loose-fill insulation.

SUMMARY OF THE DISCLOSURE

One aspect of the disclosure is an insulated building structure, the insulated building structure including

- a longitudinally-extending cavity bound by a first lateral surface, a second lateral surface, a back surface and a front surface, the cavity having a cross-sectional area in a plane normal to a longitudinal axis of the cavity;
- one or more shelves extending into the cavity, each having an occluded area in the plane that is less than the cross-sectional area of the cavity; and
- loose-fill insulation disposed in the cavity, loose-fill insulation being positioned above and below each of the shelves.

In certain such embodiments, the building structure includes

- a first stud defining the first lateral surface of the cavity;

- a second stud spaced laterally from the first stud, the second stud defining the second lateral surface of the cavity;
- a back panel extending between a back side of the first stud and a back side of the second stud, the back panel defining the back surface of the cavity;
- a front panel extending between a front side of the first stud and a front side of the second stud, the front panel defining the front surface of the cavity.

Another aspect of the disclosure is a method for insulating a building structure, the method comprising:

- providing a building structure comprising:
  - a longitudinally-extending cavity bound by a first lateral surface, a second lateral surface, a back surface and a front surface, the cavity having a cross-sectional area in a plane normal to a longitudinal axis of the cavity;
  - one or more shelves extending into the cavity, each having an occluded area in the plane that is less than the cross-sectional area of the cavity; and
- disposing loose-fill insulation in the cavity such that loose-fill insulation is positioned above and below each of the shelves.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure and together with the description serve to explain the principles and operation of the disclosure.

DETAILED DESCRIPTION

Figure 1:
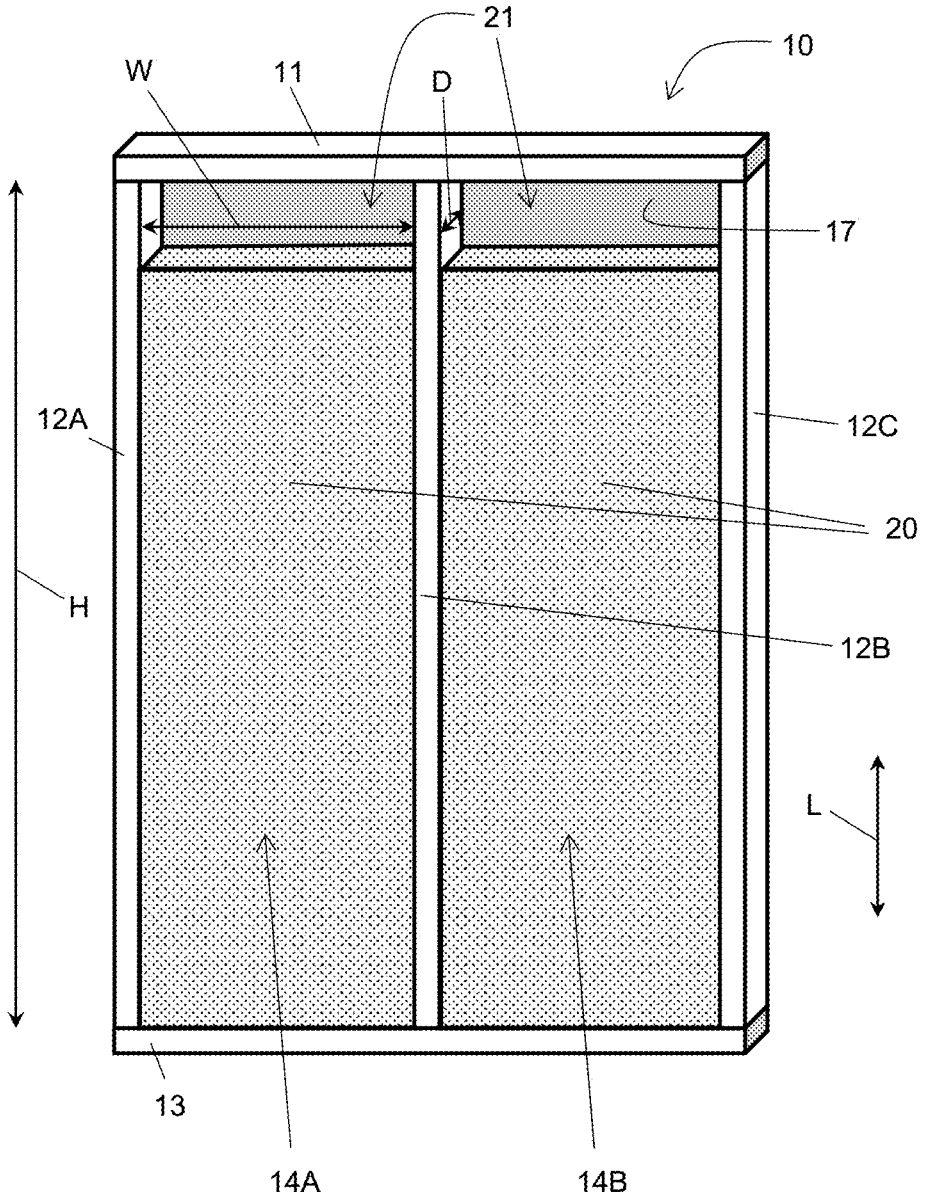
FIG. 1 is a schematic front partial view of a prior art insulated wall.

As noted above, the present inventors have noted certain disadvantages of existing processes for insulating building structures such as walls and sloped ceilings and roofs.

Accordingly, one aspect of the disclosure is an insulated building structure. Such a structure will often take the form of a wall as described with respect to the Figures below, but the person of ordinary skill in the art will appreciate that other uses are possible, such as in sloped ceilings or roofs. In fact, the methods and structures described herein can be used with respect to cavity structures having portions extending in any desired plane, e.g., a vertical plane, a horizontal plane, or an inclined direction. The insulated building structure includes a longitudinally-extending cavity bound by a first lateral surface, a second lateral surface, a back surface and a front surface, the cavity having a cross-sectional area in a plane normal to a longitudinal axis of the cavity; and one or more shelves extending into the cavity, each having an occluded area in the plane that is less than the cross-sectional area of the cavity. Disposed in the cavity is loose-fill insulation, positioned both above and below each of the shelves.

In one typical construction, the insulated building structure includes a first stud defining the first lateral surface of the cavity; a second stud spaced laterally from the first stud, the second stud defining the second lateral surface of the cavity; a back panel extending between back sides of the first and second studs, the back panel defining the back surface of the cavity; and a front panel extending between front sides of the first and second studs, the front panel defining the front surface of the cavity, such that the two studs and two panels define the cavity therebetween. The longitudinal axis of the first stud defines the longitudinal axis of the cavity. The one or more shelves disposed in the cavity are positioned between the first stud and the second stud. As used herein, the term "stud" encompasses other substantially linear framing members, including joists.

Another aspect of the disclosure is a method for insulating building cavity, e.g., a wall cavity. The method comprises providing a structure as described herein (i.e., including a cavity with one or more shelves extending therein), and applying loose-fill insulation in the cavity, such that each of the one or more shelves has insulation disposed above it and below it.

When compared to other systems for insulating a building cavity with loose-fill insulation, the disclosed systems and methods can be advantaged in that, in certain embodiments, the shelf or shelves support at least part of the weight of the insulation. As such, the weight supported by the shelf does not act upon the insulation positioned below the shelf, thus reducing the compression and settling of the insulation over time.

When compared to other systems for insulating a building cavity with loose-fill insulation, the disclosed systems and methods can provide an advantage that, in certain embodiments, the shelf or shelves provide additional surface area to bear the weight of the loose-fill insulation, and thus allow for a more uniform distribution of insulation throughout the structure. The additional surface area provides greater opportunities for fiction between the fibers of the insulation and the shelves and other cavity surfaces, and such friction will reduce the compression or settling of the insulating material over time.

Settling of insulation may occur from vibrations that the cavities may experience at any point in their life of use. This could occur during the process of installation of the insulation into the cavity, after the cavity experiences a shock (due to earthquake, or other seismic event), or from transport of pre-filled cavities from location of manufacture to location of end use. Even the change of orientation of cavities or cavity elements that may be filled while assembled prone in a manufacturing environment to a vertical location for assembly into a larger structure could cause settlement to occur.

Notably, the sizes and arrangements of the one or more shelves can be selected by the person of ordinary skill in the art to allow for insulation to be blown past them during installation. In certain embodiments, each of the shelves has a first end adjacent to a first surface defining the cavity and a second end distal the first surface and spaced from a second surface defining the cavity, the second surface being opposite the first surface. For example, in certain embodiments as otherwise described herein, one or more or the shelves has a first end adjacent the first lateral surface of the cavity and a second end distal the first lateral surface of the cavity and spaced from the second lateral surface of the cavity. In certain embodiments as otherwise described herein, one or more of the shelves has a first end adjacent the second lateral surface of the cavity and a second end distal the second lateral surface of the cavity and spaced from the first lateral surface of the cavity. In certain embodiments as otherwise described herein, one or more of the shelves has a first end adjacent the front surface of the cavity and a second end distal the front surface of the cavity and spaced from the back lateral surface of the cavity. In certain embodiments as otherwise described herein, one or more or the shelves has a first end adjacent the back surface of the cavity and a second end distal the back surface of the cavity and spaced from the front surface of the cavity.

In certain embodiments as otherwise described herein, one or more of the shelves (e.g., each of the shelves) is oblique to the plane, with a major top surface thereof being higher at its second end higher than at its first end. The angle of a major top surface of the shelf to the plane can range, for example, up to 45 degrees, e.g., up to 30 degrees, or in the range of 5-45 degrees, or 15-45 degrees, or 5-30 degrees.

In many cases, a plurality of shelves will be present in the cavity, e.g., at least four shelves, at least six shelves or even at least twelve shelves.

Referring now to the drawings, FIG. 1 is a front view of a portion of an example of a conventional wall 10 having loose-fill insulation 20 disposed in a cavity thereof. The wall 10 includes studs 12A, 12B, and 12C each having a height of H. In the embodiment of FIG. 1, a top plate 11 extends along the top ends of the studs 12A, 12B, and 12C. A sill plate or bottom plate 13 extends along the bottom ends of the studs 12A, 12B, and 12C. The wall 10 further includes a back panel 17 extending between back sides of the studs 12A, 12B, and 12C. The wall 10 further includes a front panel (not shown) extending along the front sides of the studs 12A, 12B, and 12C. The studs and panels, define cavities 14A (between studs 12A and 12B) and 14B (between studs 12B and 12C), here also defined vertically by the plates.

The person of ordinary skill in the art will appreciate that the materials of the structures described herein can vary. Studs can be formed of, for example, wood or metal. The front panel and back panel can be formed of the same material or different materials. Each can be formed of a material that serves as the outer surface of the structure, such as wallboard, lath and plaster, or sheathing (e.g., gypsum board, oriented strand board (OSB), fiberboard, plywood, foam boards, brick, masonry, unitary block, stone, or other common construction materials). But the person of ordinary skill in the art will appreciate that insulation is often blown into a building cavity before the cavity is closed off with its ultimate surface material. In such cases, a sheet of flexible material. e.g., fabric, mesh, or plastic sheeting, acts as the front panel closing off the cavity for the purpose of blowing in the loose-fill insulation. An opening can be provided in such a sheet to allow access of a tube to the cavity for blowing in of the insulation. This sheet can later be covered by a surface material such as wallboard, lath and plaster, or sheathing. In certain embodiments as otherwise described herein, the back surface defining the cavity is provided by wallboard, lath and plaster, or sheathing, and the front panel defining the cavity is provided by a sheet of flexible material such as a fabric, mesh, or plastic sheet.

In the embodiment of FIG. 1, the cavities 14A, 14B are the same height H as the studs 12A, 12B, 12C. The cavities 14A, 14B each have a width W equal to the distance between the two studs. For example, if the studs 12A, 12B, 12C are standard two-by studs spaced according to a Sixteen Inch on Center pattern, the width W is approximately 14.5 inches. Similarly, if the studs 12A, 12B, 12C are standard two-by studs spaced according to a Twenty-four Inch on Center pattern, the width W is approximately 22.5 inches. But these are just examples, and the person of ordinary skill in the art will appreciate that other widths W are contemplated herein. The cavities 14A, 14B have a depth D approximately equal to the depth of the studs 12A, 12B, 12C. For example, the depth D is approximately 3.5 inches for 2×4 studs, approximately 5.5 inches for 2×6 studs, and approximately 7.25 inches for 2×8 studs. As above, other depths are contemplated herein.

Accordingly, the cavities 14A. 14B each have a cross-section area in a plane normal to the longitudinal axis L of the first stud 12A, e.g., the horizontal plane for vertical walls, of W×D.

As shown, the cavities 14A, 14B each contain loose-fill insulation 20. However, the loose-fill insulation 20 has compressed and settled, leaving a voids 21 proximate the top of the cavities 14A, 14B.

Figure 2:
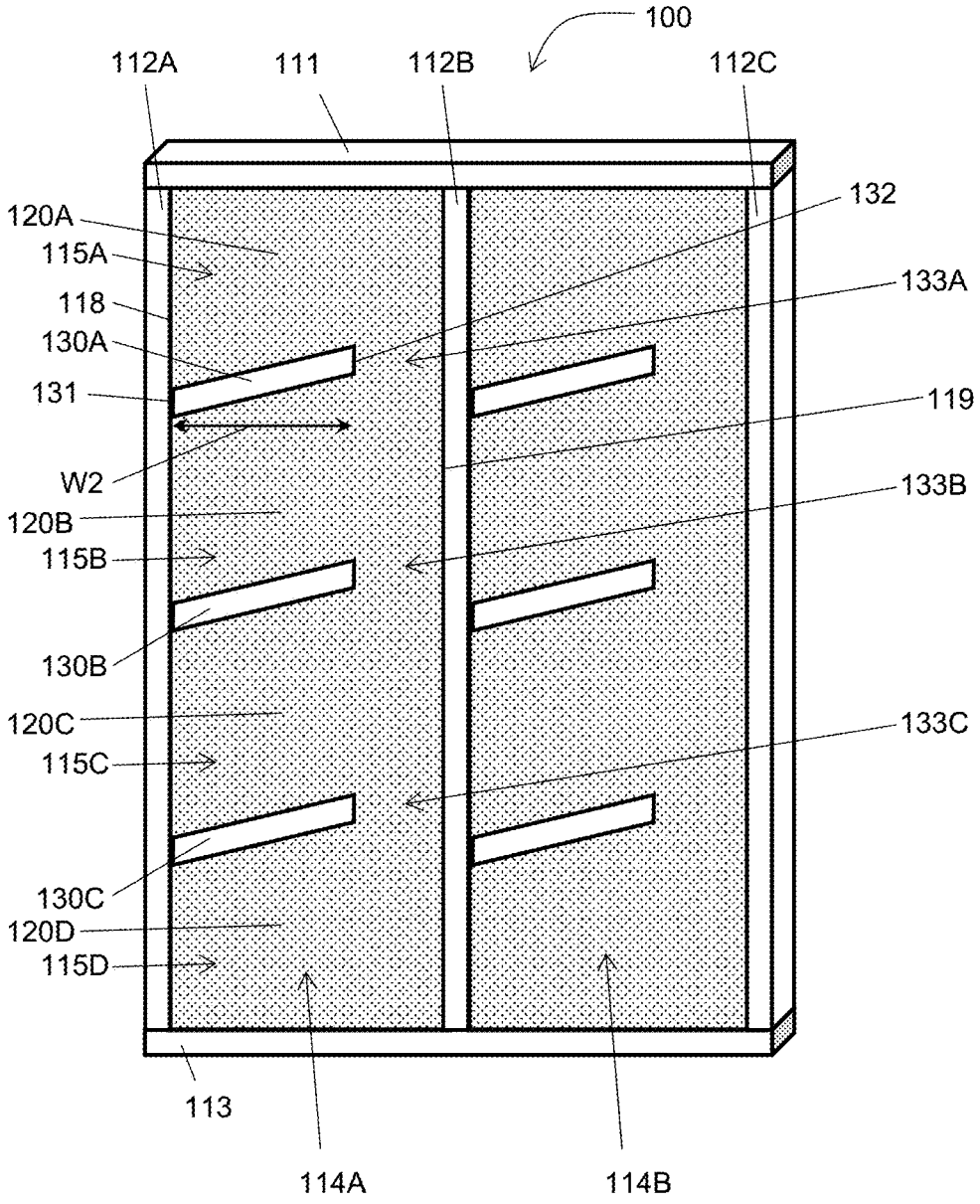
FIG. 2 is a schematic cross-sectional view of an insulated wall, according to one embodiment of the disclosure.

Turning to FIG. 2, a system 100 for insulating a building cavity is shown. The system 100 includes studs 112A, 112B, 112C, a top plate 111, and a bottom plate 113 substantially similar to those shown in FIG. 1 and described above. The system 100 further includes a back panel 117 and front panel 116 (see FIG. 5) substantially similar to those described above. The studs 112A, 112B, 112C, panels, and plates 111, 113 define cavities 114A, 114B. The cavities 114A, 114B each have a height of H, a width of W, and a depth of D (see FIG. 1). Accordingly, the cavities each have a cross-sectional area in a plane normal to the longitudinal axis L of the first stud 112A equal to W×D.

In the embodiments depicted herein, the system 100 forms a vertical wall 101, and therefore the plane is the horizontal plane. However, it is to be understood that the system described can be used for ceilings and roofs, such as sloped ceilings, in which the studs 112A, 112B, 112C are the ceiling joists. In certain embodiments as otherwise described herein, the cavity extends longitudinally (e.g., the studs are disposed) at an angle that is no more than 60 degrees from vertical, e.g., no more than 45 degrees from vertical. In certain embodiments as otherwise described herein, the cavity extends longitudinally (e.g., the studs are disposed) at an angle that is no more than 30 degrees from vertical. e.g., no more than 15 degrees from vertical. In certain embodiments, the cavity extends longitudinally (e.g., the studs are disposed) at an angle that is no more than 5 degrees from vertical. The systems described herein are especially advantageous with cavities that extend substantially vertically, as it is in such cavities that settling of loose-fill insulation is more of an issue.

The system 100 of FIG. 2 further includes a plurality of shelves 130A-C positioned in each cavity 114A, 114B. In this embodiment, each of the shelves 130A-C is substantially similar. Shelf 130A is discussed in greater detail below as an illustrative example.

The shelf 130A of the embodiment of FIG. 2 includes a first end 131 and a second end 132. The first end is adjacent to a surface 118 defining one edge of the cavity 114A. In the shown embodiment, the surface 118 adjacent to the first end 131 of the shelf 130A is the first stud 112A. In some forms, the first end 131 is coupled to the stud 112A. The second end 132 is opposite the first end 131 and distal from the surface adjacent thereto (e.g., the first stud 112A). In a preferred form, the shelf is oblique to the plane normal to the axis L, such that the second end 132 of the shelf 130A is higher than the first end 131. Accordingly, the weight of the first portion 120A of insulation, the insulation located above the first shelf 130A, partially acts to hold the portion of insulation 120A towards the first stud 112A.

The shelf 130A has a depth of D or less. As shown, the shelf has a width W2 that is less than the width W of the cavity 114A. Accordingly, the shelf 130A has an occluded area in the plane normal to L that is less than W×D.

The second end 132 of the shelf 130A is spaced from surface 119 opposite the surface 118. There is an opening 133A proximate the second end 132 of the shelf 130A through which insulation can flow from above the shelf 130A to below the shelf 130A. In operation, insulation is blown into the cavity 120A from a single point. The point of installation may be a hole in the wall or in a film or blanket defining the front surface of the cavity. Alternatively, the point of installation may be the top of the wall through the top plate 111. During installation, insulation passes through the openings 133A, 133B, 133C so as to fill each section 115A, 115B. 115C of the cavity 114A. After installation, the insulation is partially divided into sections 120A, 120B, 120C, 120D by the shelves 130A, 130B, 130C. The shelves 130A, 130B, 130C partially support the weight of the section of insulation 120A, 120B, 120C located above the shelf. This reduces the amount of pressure acting to compress the insulation located below the respective shelves.

Figure 3:
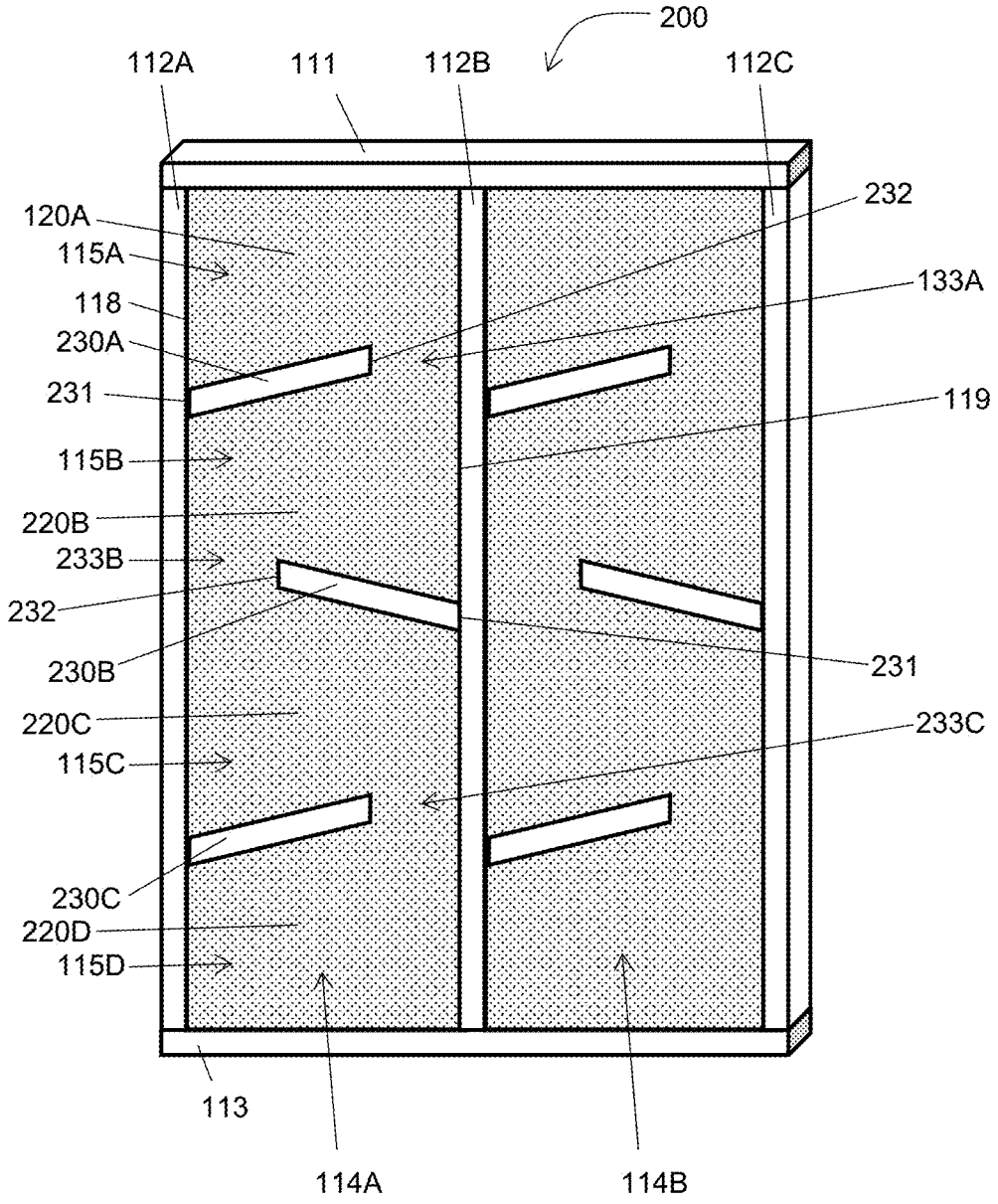
FIG. 3 is a schematic cross-sectional view of an insulated wall, according to an alternative embodiment of the disclosure.

FIG. 3 illustrates a system 200 having an alternative arrangement of shelves 230A, 230B, 230C. The odd shelves 230A, 230C are substantially similar to the corresponding shelves 130A, 13C shown in FIG. 2 and discussed above. The even shelves 230B are mirrored compared to the corresponding shelves 130A shown above.

The system 200 includes a first shelf 230A having a first end 231 coupled to the first stud 112A. The first shelf 230A extends into the cavity 114A towards the second stud 112B. There is an opening 233A between the second end 232 of the first shelf 230A and the second stud 112B.

The system further includes a second shelf 230B having a first end 231 coupled to the second stud 112B. The second shelf 230B extends into the cavity 114A towards the first stud 112A. There is an opening 233B between the second end 232 of the second shelf 230B and the first stud 112A.

As shown, the first opening 233A and the second opening 233B are laterally offset from each other. Accordingly, insulation directly above the first opening 233A is at least partially supported by the second shelf 230B. Similarly, insulation directly above the second opening 233B is at least partially supported by a third shelf. Offsetting the openings 233A-C in this manner reduces the amount of force acting to compress the insulation in line with the openings 233A-C.

While the illustrated example shows three shelves 230A-C in each cavity 114A, 114B, it is understood that the embodiment is not limited to three shelves. The system 200 includes two or more shelves in an alternating arrangement spaced along the height H of the cavity 114A.

Figure 4:
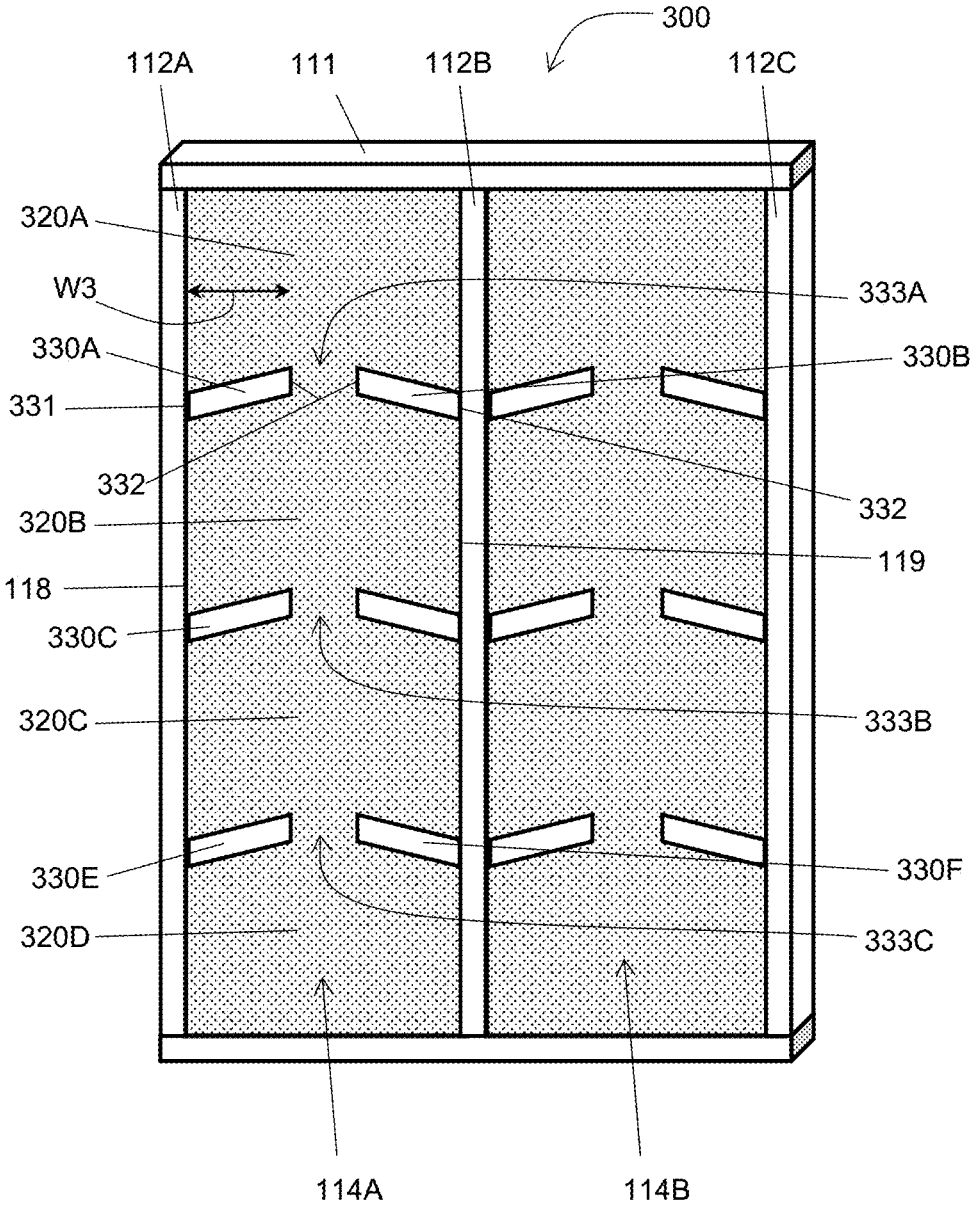
FIG. 4 is a schematic cross-sectional view of an insulated wall, according to another alternative embodiment of the disclosure.

FIG. 4 illustrates a system 300 having another arrangement of shelves 330A-330F. As shown, the shelves are arranged in pairs 330A-B, 330C-D, 330E-F. Each pair of shelves are substantially level with each other, being installed at common locations along the height H of the cavity 114A. In this embodiment, the pairs of shelves are installed so that their angles mirror each other; however, the person of ordinary skill in the art will appreciate that other arrangements are possible. The shelves 330A-F divide the insulation into sections 320A-D.

Shelf 330A has a first end 331 adjacent to a first surface 118. In the shown embodiment, the first surface 118 is the first stud 112A. The shelf 330A has a second end 332 distal from the first surface 118. The second shelf 330B has a first end 331 adjacent to a second surface 119 opposite the first surface 118. In the shown embodiment, the second surface 119 is the second stud 112B. The second shelf 330B has a second end 332 distal from the second surface 19. The second ends 332 of the two shelves 330A-B are spaced apart from each other, defining an opening 333A therebetween. As discussed above, the opening 333A enables insulation to flow between sections 115A, 115B of the cavity 114A during installation.

The remaining pairs 330C-D, 330E-F are substantially similar to the pair 330A-B described above. In the shown form, the openings 333A-C are aligned. However, it is understood that the lengths of the shelves 330A-F could be adjusted to offset the openings for the reasons discussed above.

As shown, the shelf 330A has a shorter width W3 than the shelf 130A of the embodiment of FIG. 2. Shortening the shelf 330A in this manner reduces the amount of torque on the joint between the first end 331 of the shelf 330A and the first surface 118. The torque can further be reduced by attaching the second ends 332 of the pair of shelves 330A-B by a plate located at the front and/or back thereof.

Each of the embodiments above illustrate systems in which the shelves are adjacent to a first stud 112A and spaced from a second stud 112B, thus leaving an opening between the shelf and the second stud 112B through which insulation can flow. However, a similar affect can be achieved by having shelves expanding the entire width of the cavity 114A that is adjacent to one of the back panel and the front panel and spaced from the other of the back panel and the front panel. Such arrangement are shown in FIG. 5 and discussed below.

Figure 5:
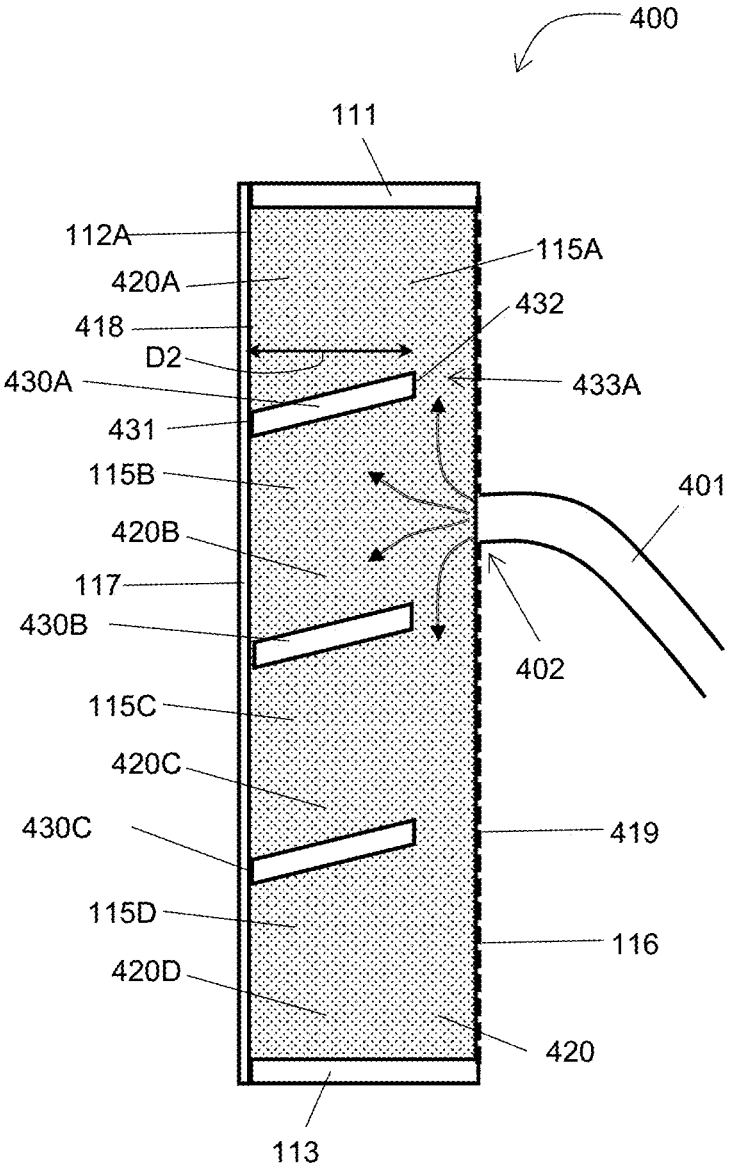
FIG. 5 is a schematic cross-sectional view of a method for insulating a wall, according to one embodiment of the disclosure.

FIG. 5 illustrates a system 400. FIG. 5 is a cross section of a cavity 114A showing the top plate 111, bottom plate 113, front panel 116, and back panel 117. It is understood that the cavity 114A is further defined by a first stud 112A and second stud 112B as shown in previous embodiments. The front panel 116 is formed of a flexible sheet, such as a blanket for securing the insulation 420 in place during installation. When the wall is completed, the front panel 116 will be replaced by or covered by a solid wall material, such as sheathing, wallboard, or lath and plaster. Alternatively, the front panel 116 may remain in place and be permanently covered by an additional solid wall material layer such as sheathing, wallboard, or lath and plaster.

The system 400 includes a plurality of shelves 430A-C disposed within the cavity 114A. The shelves 430A-430C are substantially similar. The first shelf 430A is described below as an illustrative example, The shelf 430A has first end 431 adjacent to a first surface 418 defining the cavity 114A. In the shown form, the first surface 418 is the back panel 117. The shelf 430A has a second end 432 distal from the first surface 418. The shelf 430A is oblique to the plane normal to the axis L such that the second end 432 is higher than the first end 431.

The shelf 430A extends the entire width W of the cavity 114A. The shelf 430A is coupled to the first stud 112A and the second stud 112B. However, the shelf 430A has a depth D2 less than the depth D of the cavity 114A. Accordingly, the shelf 430A has an occluded area in the plane normal to the axis L that is less than W×D.

The second end 432 of the shelf 430A is spaced from the front panel 116, defining an opening therebetween. FIG. 5 illustrates the installation process of the insulation 420. As shown, a hose 401 is positioned in an aperture 402 in the front panel 116. The end of the hose 401 is in the section 115C of the cavity 114A between the second shelf 430B and third shelf 430C. Insulation 420 is blown into the cavity 114A from the hose 401. The insulation 420 flows through the opening 433A-C between the shelves 430A-C and the front panel 116 to fill each section 115A-D of the cavity 114A. As in previous embodiments, each shelf 430A-C at least partially supports the weight of the section 420A-C of insulation positioned thereabove.

While the shelves 430A-430C are each adjacent to the same surface 418, it is understood that other embodiments similar to those discussed above are considered herein. For example, the even shelves 430B can be mirrored to be adjacent to the opposite surface 419 so as to offset the openings 433A-C as in FIG. 3. Alternatively, the shelves 430A-C can be arranged in pairs as shown in FIG. 4.

In other embodiments the shelves can project from the back panel without contacting the studs. In such cases the shelves can be affixed to the back panel and extend forward towards the front panel. In certain such embodiments, the shelves extend a distance that is less than W to serve to segment the cavity into zones where insulation can build up, but still have areas that allow the insulation to be distributed to other zones within the cavity.

Figure 6:
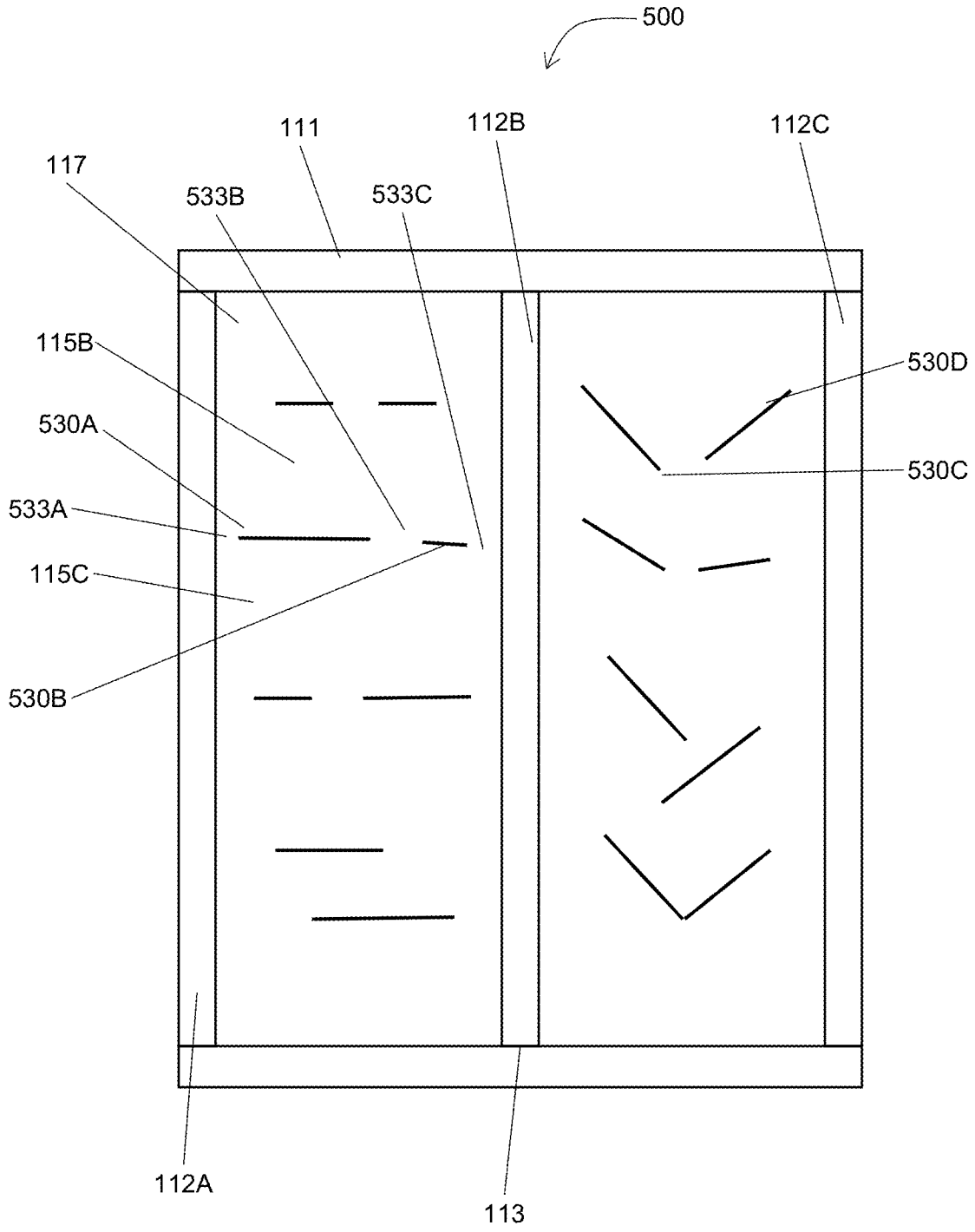
FIG. 6 is a schematic cross-sectional view of a wall having shelves for supporting insulation, according to another alternative embodiment of the disclosure.
Figure 7:
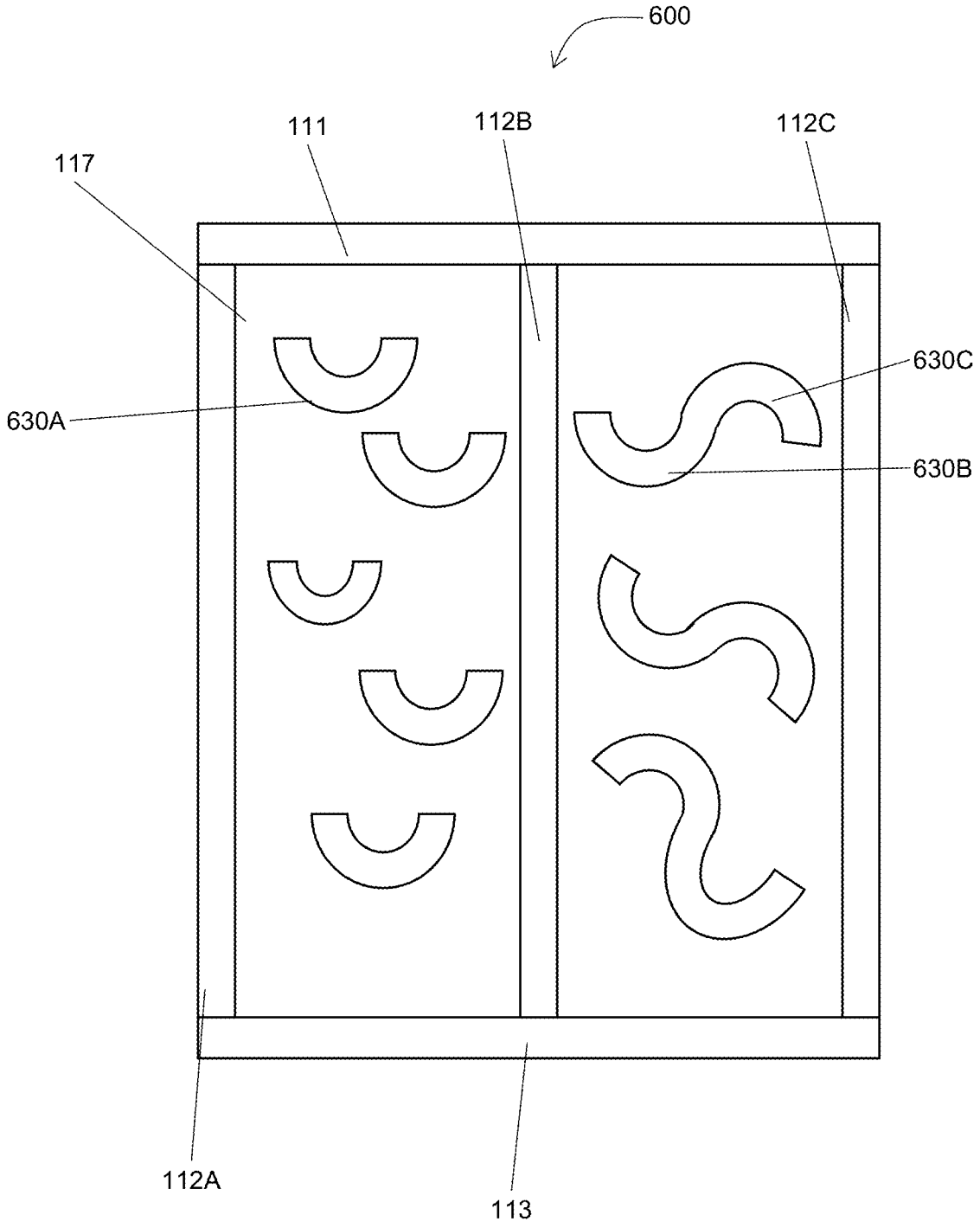
FIG. 7 is a schematic cross-sectional view of a wall having shelves for supporting insulation, according to another alternative embodiment of the disclosure.
Figure 8:
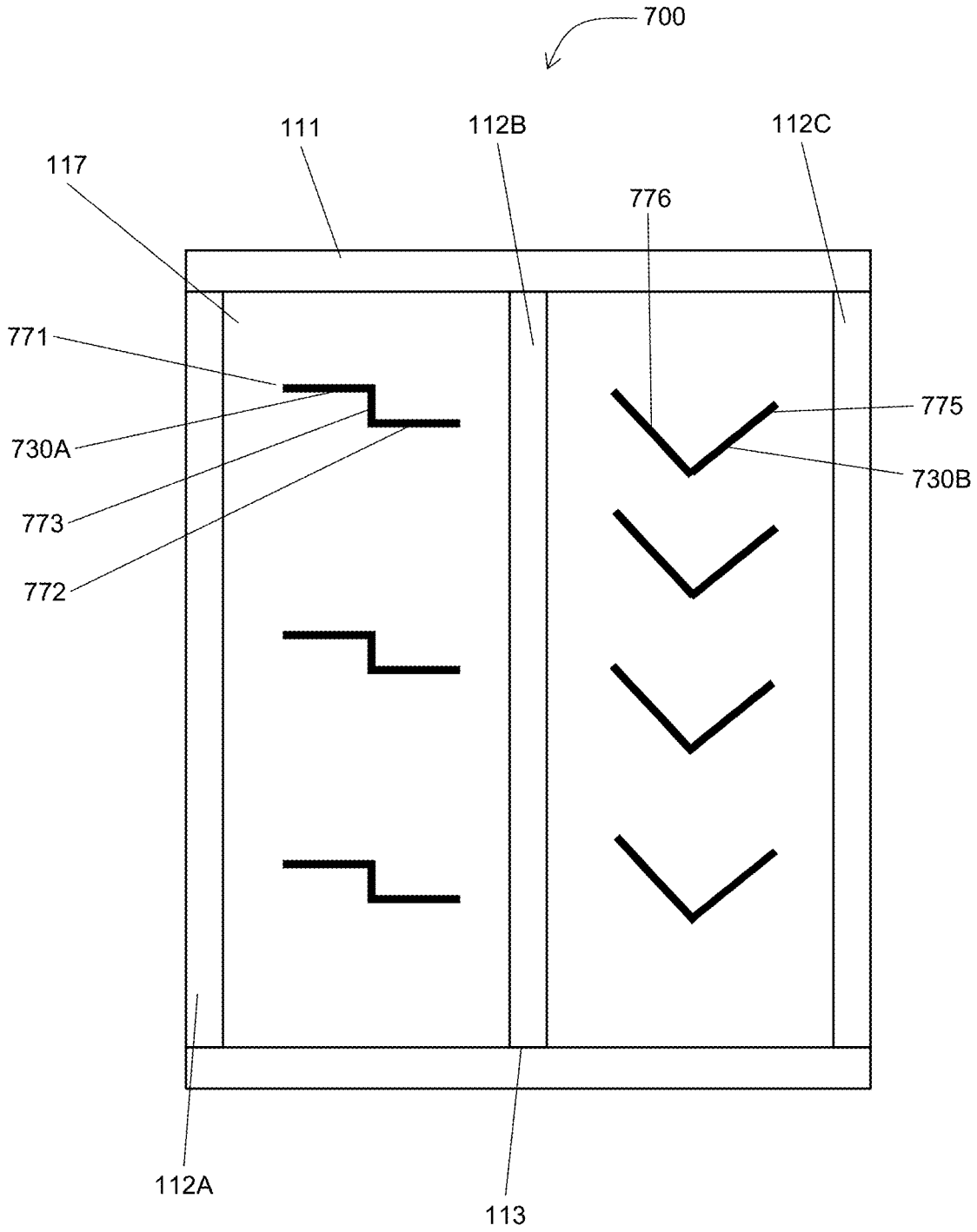
FIG. 8 is a schematic cross-sectional view of a wall having shelves for supporting insulation, according to another alternative embodiment of the disclosure.

For example, in the various embodiments shown in FIGS. 6-8, the shelves are not connected to any of the studs 112A-C. Turning first to FIG. 6, the system 500 has a plurality of shelves 530A-D. The shelves 530A-D are coupled to the back panel 117.

Shelf 530A is located between studs 112A and 112B. Shelf 530A is spaced from both studs 112A and 112B. Shelf 530B is horizontally spaced from shelf 530A and also located between studs 112A and 112B. Shelf 530B is spaced from both studs 112A and 112B. Accordingly, the cavity sections 115B and 115C are connected by three channels 533A-C to aid in the installation of loose fill insulation (not shown) as described above. As shown, the shelves 530A and 530B are horizontal. However, shelves can also be angled such as shelves 530C and 530D.

Shelves 530C-D are positioned between studs 112B and 112C. The shelves 530C-D are horizontally spaced from each other and are each horizontally spaced from both studs 112B and 112C. Accordingly, the shelves 530C-D similarly define three channels through which insulation can flow.

Turning to FIG. 7, the system 600 includes a plurality of shelves 630A-C having an arc shape. The shelves 630A-C are each spaced from all studs 112A-C and are instead coupled to the back panel 117.

In some forms, the shelves 630A have an upward facing arc shape. The upward facing arc shape is configured to support insulation when the system 600 is in a vertical orientation. In alternative forms, the shelves 630B-C have different orientations, such as one upward and one downward. The different orientations of shelves provide support for the insulation as the system 600 is turned or flipped, such as in applications within prefabricated structures as described below.

In some forms, the shelves 630B-C are arranged in interlocking pairs. The first end of shelf 630B interlocks with the second end of shelf 630C to form a single, continuous shelf. In alternative forms, additional interlocking shelves can be in turn connected to opposite ends of shelf 630B or 630C to form a still longer continuous shelf.

FIG. 8 illustrates a system 700 having additional alternative shelf shapes. The system 700 includes stepped shelves 730A and V-shaped shelves 730B. The shelves 730A-730B are spaced from the studs 112A-C. The shelves 730A-730B are coupled to the back panel 117.

The stepped shelves 730A have a first horizontal portion 771 and a second horizontal portion 772 connected by a vertical portion 773. However, it is understood that the stepped shelf 730A can be installed in alternative orientations such that the parallel sections 771 and 772 are vertical or oblique to the vertical axis.

The V-shaped shelves 730B are formed of two sections 775 and 776 angled relative to each other. While each of the shown shelves 730B are vertical, it is understood that one or more of the shelves 730B can be rotated to provide support for insulation in different directions.

In each of the embodiments above, the shelves are represented by solid lines. However, shelves formed of non-solid materials are considered herein. For example, any of the shelves discussed above can be formed of mesh, slats, rods, pins, or other materials. In some forms, the shelves are formed of wood, metal, or plastic with one or more apertures therethrough. The apertures or openings in non-solid shelves enable air flow through the shelves during pneumatic filling operations. This additional air flow aids in an even distribution of insulation throughout the cavity.

Based on the disclosure herein, the person of ordinary skill in the art can select sizes and patterns of shelves to provide a reduced degree of insulation settling while still allowing loose-fill insulation to substantially fill the cavity in a blown-in installation process.

Each of the shelves has an occluded area in the plane normal to the longitudinal direction of the cavity. The occluded area is the cross-sectional area of the cavity that is blocked by the shelf. As noted above, the occluded area is less than the cross-sectional area of the cavity (i.e., in the plane normal to the longitudinal direction thereof). In certain embodiments as otherwise described herein, each shelf has an occluded area of no more than 90% of the cross-sectional area of the cavity. In certain desirable embodiments, each shelf has an occluded area of no more than 80%, no more than 70%, no more than 60%, or even no more than 50% of the cross-sectional area of the cavity. In certain embodiments as otherwise described herein, each shelf has an occluded area of at least 5% of the cross-sectional area of the cavity. In certain desirable embodiments, each shelf has an occluded area of at least 10%, at least 15%, or even at least 20% of the cross-sectional area of the cavity. For example, in various embodiments, each shelf has an occluded area in the range of 5-90%, e.g., 5-80%, or 5-70%, or 5-60%, or 5-50%, or 10-90%, or 10-80%, or 10-70%, or 10-60%, or 10-50%, or 15-90%, or 15-80%, or 15-70%, or 15-60%, or 15-50%, or 15-90%, or 20-80%, or 20-70%, or 20-60%, or 20-50% of the cross-sectional area of the cavity. The person of ordinary skill in the art will select shelf sizes together with number of shelves to provide a configuration that allows insulation to be blown in past the shelves during insulation yet provide sufficient support to the insulation after installation.

In certain embodiments, each of the shelves has a depth that is at least 25% of the depth of the cavity (i.e., at the position where it is disposed). For example, in certain embodiments, each of the shelves has a depth that is at least 40%, e.g., at least 50%, or at least 60% of the depth of the cavity. When a shelf does not extend the full width of the cavity (e.g., extends no more than 70%, no more than 60%, no more than 50% of the width of the cavity), it can in some embodiments extend the full depth of the cavity. In certain embodiments in which a shelf extends a substantial fraction of the full width of the cavity (e.g., at least 50%, at least 60%, or at least 70% of the width of the cavity), the shelf extends no more than 70% of the depth of the cavity, e.g., no more than 60%/o, or no more than 50% or no more than 40% of the depth of the cavity. In certain embodiments as otherwise described herein, each of the shelves has a depth in the range of 25-100% of the depth of the cavity, e.g., 25-70%/o, or 25-60%, or 25-50%, or 40-100%, or 40-70%, or 40-60%, or 50-100%, or 50-70%, or 60-100% of the depth of the cavity.

In certain embodiments, each of the shelves has a width that is at least 20% of the width of the cavity (i.e., at the position where it is disposed). For example, in certain embodiments, each of the shelves has a width that is at least 30%. e.g., at least 40%, or at least 50% of the width of the cavity. When a shelf does not extend the full depth of the cavity (e.g., extends no more than 70%, no more than 60%, no more than 50% of the depth of the cavity), it can in some embodiments extend the full width of the cavity. In certain embodiments in which a shelf extends a substantial fraction of the full depth of the cavity (e.g., at least 50%, at least 60%, or at least 70% of the depth of the cavity), the shelf extends no more than 70% of the width of the cavity, e.g., no more than 60%, or no more than 50% or no more than 40% of the width of the cavity. In certain embodiments as otherwise described herein, each of the shelves has a width in the range of 25-100% of the depth of the cavity, e.g., 25-70%, or 25-60%, or 25-50%, or 40-100%, or 40-70%, or 40-60%, or 50-100%, or 50-70%, or 60-100% of the width of the cavity.

In certain embodiments, shelves are provided in a cavity so that the average insulation height, i.e., taken as an average height of insulation (between shelves, or between a shelf and a top of the body of insulation, or between the bottom of the cavity and a shelf) in the longitudinal direction (e.g., parallel to the first stud) is no more than 4 feet. That is, averaged over the cavity, the height of the body of insulation between supporting surfaces is no more than 4 feet. For example, in certain embodiments as otherwise described herein, the average height of insulation is no more than 3 feet, e.g., no more than 2 feet.

In certain embodiments, shelves are positioned in the cavity so that the maximum insulation height possible in the longitudinal direction in a fully-filled cavity is no more than 4 feet. For example, in certain embodiments as otherwise described herein, the maximum possible insulation height in the longitudinal direction is no more than 3 feet, e.g., no more than 2 feet.

Shelves can be arranged by the person of ordinary skill in the art in a variety of fashions based on the disclosure herein. For example, in certain embodiments, shelves extend in an alternating fashion, e.g., alternating between extending from the first stud or the second stud, or alternating between extending from the front panel and the rear panel. But in other embodiments, shelves extend in the same direction throughout the cavity. e.g., from the back panel.

Shelves can be formed from a variety of materials, e.g., plastic, wood, fabric (e.g., supported or made rigid), cardboard, gypsum or metal. They can be affixed to studs and/or panels in a variety of manners, e.g., with nails, staples, screws, brackets, pressure sensitive adhesives or glue.

The disclosure also provides a method for insulating a building structure, such as a wall, ceiling or roof as described above. The method includes providing a building structure in any configuration as described above, e.g., including a first stud; a second stud spaced laterally from the first stud; a back panel extending between a back side of the first stud and a back side of the second stud; a front panel extending between a front side of the first stud and a front side of the second stud, wherein the first stud, second stud, back panel, and front panel define a cavity therebetween having a first cross-sectional area in a plane normal to a longitudinal axis of the first stud; and a first shelf disposed in the cavity, wherein the first shelf has an occluded area in the plane smaller than the first cross-section area. The method further comprises disposing loose-fill insulation in the cavity such that loose-fill insulation is positioned above and below each of the shelves. As described above, a plurality of shelves can be disposed in the cavity to provide improved support for insulation while still allowing insulation to flow around the shelves in the blowing-in process; loose-fill insulation will be disposed above and below each of the shelves.

The building structure itself (i.e., not including the insulation) can be as described in any of the various embodiments above.

The methods and structures of the disclosure can be useful in a variety of construction contexts. For example, a building structure including shelves as described herein can be provided as part of a building, then insulated by blowing in insulation.

The present inventors have also determined that the methods and structures described herein can be especially useful in the manufacturing of prefabricated building structures. Prefabricated structures are formed of wall and/or ceiling sections that are made offsite, such as at a factory, then later installed onsite as part of a building. Accordingly, in certain embodiments as otherwise described herein, the insulated building structure is prefabricated and is not installed as part of a building. Such an insulated building structure can be transported to a building site, then installed as part of a building. Notably, during manufacturing, transportation, and installation, the prefabricated wall may be flipped, shaken, and otherwise moved. Conveniently, prefabricated building structures can be transported horizontally. In typical prefabricated wall or ceiling sections, this can cause settling of the insulation. The shelves reduces the amount of settling of the insulation as a result of this movement. In the methods and structures described herein, the shelves can help to prevent settling of the insulation during manufacturing, transportation, and installation.

One method of manufacturing a structure includes assembling a wall out of a plurality of studs, a top plate, a base plate, and inner and outer sheathings, with one or more shelves, such as those shown in FIGS. 2-8 above, positioned in the cavities of the wall. The wall cavity is also filled with loose-fill insulation.

While in methods for making a prefabricated building structure the insulation can be blown-in to an already fabricated cavity as described above, in other embodiments the insulation is dispensed in the cavity before one of the back surface and the front surface closes the cavity. This can allow for the insulation to more easily be deposited relatively uniformly throughout the cavity space, and then the front or back panel (e.g., a sheathing) can be installed to close the cavity. One advantage of such installation is that there need be no holes made in a fabric or the sheathing material. In certain embodiments, the building structure is disposed such that its longitudinally-extending direction is within 15 degrees of horizontal, e.g., within 5 degrees of horizontal when the loose-fill insulation is disposed therein A variety of loose-fill insulation materials can be used in the practice of the methods and structures described herein. For example, known insulation materials include stonewool, rockwool, fiberglass, polyester, cellulose, polystyrene pellets, vermiculite and cotton. Such materials can be provided as a bindered material or in the absence of binder, and are desirably free from adhesives, liquid and moisture that promote clumping and aggregating of fibers or nodules of material. Loose-fill materials can be products made specifically for the purpose of installing into cavities, such as Insulsafe® brand insulation (available from CertainTeed LLC), or be insulation that was formerly in the form of a batt or blanket and has been shredded or cubed to reduce the size of the particles for transport into a cavity.

In certain embodiments as otherwise described herein, the insulation used to insulate the structure is an insulation that achieves a k-value of no more than 0.31 at a density of no less than 0.37 lbs per cubic foot, a k-value of no more than 0.29 at a density of no less than 0.6 lbs per cubic foot, a k-value of no more than 0.27 at a density of no less than 0.7 lbs per cubic foot, a k-value of no more than 0.26 at a density of no less than 0.8 lbs per cubic foot, a k-value of no more than 0.25 at a density of no less than 1.0 lbs per cubic foot, a k-value of no more than 0.24 at a density of no less than 1.2 lbs per cubic foot, and a k-value of no more than 0.23 at a density of no less than 1.3 lbs per cubic foot.

The person of ordinary skill in the art can use any convenient technique to dispose the loose-fill insulation. Such insulations are typically blown in through tube, e.g., through an aperture in the front panel. Notably, because the loose-fill insulation can pass along the shelves during insulation, the insulation can be introduced into the cavity in at relatively few locations (e.g., through relatively few apertures in the front panel). For example, in certain embodiments, the insulation is introduced into the cavity at three or fewer locations, e.g., three locations, or two locations, or only one location. In a contrasting example, the insulation may be deposited manually or by machine into cavities that are positioned horizontal to the normal plane, such as in a factory to make a pre-manufactured building structure, and as such care can be taken that insulation is being installed at a specific density as well as a uniform density within the cavity space, and along the surfaces of the shelves. The presence of the shelves can help to prevent settling of the insulation due to movement shipment and assembly into a building, as well as settling over time. Of course, the person of ordinary skill in the art will appreciate that other techniques can be used to put insulation into a cavity as described herein.

Figure 9:
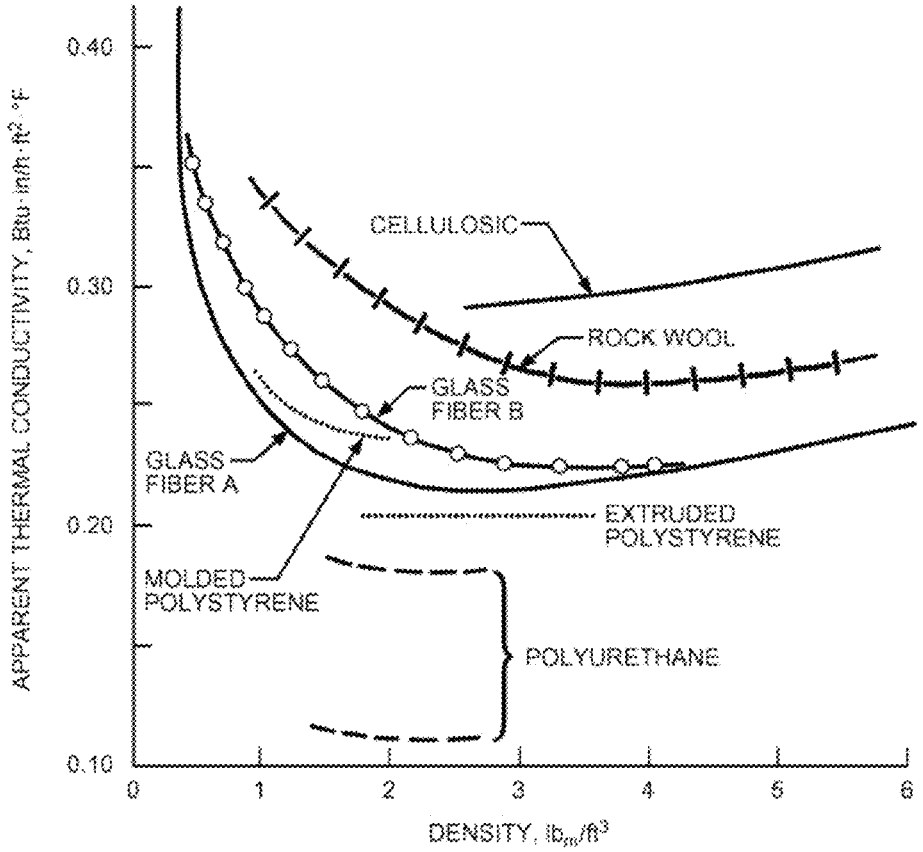
FIG. 9 is a graph of apparent thermal conductivity versus density of several thermal insulations used as building insulation.

The present inventors have noted that settling of insulation can greatly affect the overall insulating value of a building structure. In the extreme case, settling can result in voids near the top of wall; when no insulation is present in part of a wall cavity, that part of the wall can allow for heat to be efficiently transmitted therethrough. But even when voids do not form, the settling may result in a variance in the density of insulation through the wall cavity. FIG. 9 is a graph of apparent thermal conductivity versus density of several thermal insulation used as building insulation. The graph demonstrates that differences in insulation density can dramatically affect insulating quality of the insulation, especially at lower insulation densities. For example, decreasing the density of rock wool or glass fiber/fiberglass insulation from 2 pounds per cubic foot to 1 pound per cubic foot can increase the apparent thermal conductivity by more than 20%. These areas of higher thermal conductivity form thermal channels through which heat can more rapidly pass through the wall, lowering the overall U value of the structure. To protect against this, insulation is conventionally installed at a higher density than nominally required for a desired insulation value, to allow for the insulation value to remain within the specification even after some degree of settling. Use of shelves as described herein can help to reduce the variability of the insulation density, and thus can allow for use of relatively less insulation material to achieve a desired insulation value.

Referring to the graph of FIG. 9, a target insulation density is conventionally chosen along the flat part of a curve for a given material, so that a reduction in density at certain points due to settling does not cause a large increase in thermal conductivity (typically greater than 2.4 lbs per cubic foot for fiberglass insulation materials and greater than 4 pounds per cubic foot for rockwool). Accordingly, conventional insulation is dispensed at a density somewhat higher than strictly necessary, so as to insure that a desired level of thermal insulation remains even if density in certain areas of the structure is reduced due to settling. With the use of shelves as described herein to support the insulation in the cavity, the need to be at an increased density can in certain embodiments be reduced or eliminated. As such, in certain embodiments as otherwise described herein, an equivalent thermal performance density can be selected, such as 1.6 lbs per cubic foot for fiberglass insulation (a reduction of 30% as compared to conventional) or a density of 3 lbs per cubic foot for rock wool insulation (a reduction of 25% as compared to conventional) to provide a roughly equivalent thermal conductivity value or k value. While such densities are closer to the edge of a dropoff of insulation value with respect to a reduction in density, a reduction of density is far less likely as a result of the presence of the shelves. As will be understood by one of skill in the art, at similar k values (which are the inverse of R-values) a wall section can thus meet a thermal R value requirement with considerably less mass of insulation material installed.

In a typically wall assembly, it is desirable to achieve either an R-11, R-13, R-14 or R-15 in the space of a standard 2×4 wall stud cavity (3.5 inches of actual depth D), R-19, R-21 or R24 in a standard 2×6 wall stud cavity (5.5 inches of actual depth D), or R-29 or R-31 in a standard 2×8 wall stud cavity (7.25 inches of actual depth D).

Fora 2×4 wall stud cavity, an R-14 wall requires a k-value of 0.25, and an R-15 wall requires a k-value of 0.24. Being able to deliver such a k-value at closer to the target design density of 1.0 lbs per cubic foot for fiberglass insulation compared to the more typical 1.6 to 2.4 lbs per cubic foot density required to ensure that settling does not greatly affect heat conductivity occurs can reduce the use of material by anywhere from 30% to 58%. To achieve the higher k-values of 0.27 required for the R-13 wall and 0.32 required for R-11, the respective densities could be reduced to 0.7 lbs per cubic foot for R-13 and even 0.37 lbs per cubic foot for R-11. These are far lower than the typical densities that would be required in conventional cavity wall installation of loose-fill fiberglass materials—which often quote a density of 1.2 lbs per cubic foot at a minimum for a 2×4 construction.

The effect can become even more pronounced for thicker wall sections. In the case of an R-19 wall with a 2×6 stud cavity (5.5 inches of depth D), a k-value of 0.29 is required thermally. But if a minimum density of 1.6 lbs per cubic foot was required to provide for a degree of settling, such a wall would be over-insulated because the required density to achieve the 0.29 k-value is only 0.6 lbs per cubic foot. Being able to achieve this thermal value through use of shelves as described herein can result in a savings of 62% of the material used and still achieve the same overall R-value performance. Similarly, a density of 0.8 lbs per cubic foot could deliver the k-value of 0.26 required for the R-21 wall of 2×6 construction (5.5 inches of depth D). Finally, the R-24 wall of 2×6 construction (5.5 inches of depth D) requires a k-value of 0.23 to achieve its thermal rating—which can now be achieved at 1.3 lbs per cubic foot density rather than at 1.6 lbs per cubic foot or higher as typically prescribed (still a savings of over 18%).

For a 2×8 wall (7.25 inches of depth D), to achieve an R-29 a k-value of 0.25 is required. This is conventionally a recommended installation density of 1.2 lbs per cubic foot—but the desired k-value could be achieved at a 20% lower density of 1.0 lbs per cubic foot instead using shelves to prevent settling as described herein. As for an R-31 wall (k-value of 0.24), 1.2 lbs per cubic foot density could be provided when using shelves as described herein, as compared to the conventional density of 1.6 lb per cubic foot (25% savings of material).

As loose-fill insulation is typically sold in the form of a bag or compressed bale of material, this reduction of density means that fewer bags of insulation material would be required for insulating the same space to the same R-value as required by the appropriate local code. This reduction means a more efficient use of natural resources, fewer bags of insulation that need to be lifted and handled by the installer, and fewer bags of insulation that would need to be delivered to the jobsite for installation—providing for economic, environmental and ergonomic improvements for all.

Additional aspects of the disclosure are provided by the enumerated embodiments below, which can be combined in any number and in any fashion that is not technically or logically inconsistent.

Embodiment 1. An insulated building structure comprising:

- a longitudinally-extending cavity bound by a first lateral surface, a second lateral surface, a back surface and a front surface, the cavity having a cross-sectional area in a plane normal to a longitudinal axis of the cavity;
- one or more shelves extending into the cavity, each having an occluded area in the plane that is less than the cross-sectional area of the cavity;
- loose-fill insulation disposed in the cavity, loose-fill insulation being positioned above and below each of the shelves.

Embodiment 2. The insulated building structure of embodiment 1, wherein the building structure comprises:

- a first stud defining the first lateral surface of the cavity;
- a second stud spaced laterally from the first stud, the second stud defining the second lateral surface of the cavity;
- a back panel extending between a back side of the first stud and a back side of the second stud, the back panel defining the back surface of the cavity;

a front panel extending between a front side of the first stud and a front side of the second stud, the front panel defining the front surface of the cavity.

Embodiment 3. The insulated building structure of embodiment 1 or embodiment 2 wherein each of the shelves has a first end adjacent to a first surface defining the cavity and a second end distal the first surface and spaced from a second surface defining the cavity, the second surface being opposite the first surface.

Embodiment 4. The insulated building structure of any of embodiments 1-3 wherein one or more of the shelves has a first end adjacent the first lateral surface of the cavity and a second end distal the first lateral surface of the cavity and spaced from the second lateral surface of the cavity.

Embodiment 5. The insulated building structure of any of embodiments 1-4 wherein one or more of the shelves has a first end adjacent the second lateral surface of the cavity and a second end distal the second lateral surface of the cavity and spaced from the first lateral surface of the cavity.

Embodiment 6. The insulated building structure of any of embodiments 1-5 wherein one or more of the shelves has a first end adjacent the front surface of the cavity and a second end distal the front surface of the cavity and spaced from the back lateral surface of the cavity.

Embodiment 7. The insulated building structure of any of embodiments 1-6 wherein one or more or the shelves has a first end adjacent the back surface of the cavity and a second end distal the back surface of the cavity and spaced from the front surface of the cavity.

Embodiment 8. The insulated building structure of any of embodiments 3-7 wherein one or more of the shelves (e.g., each of the shelves) is oblique to the plane such that a major top surface of the shelf is higher at its second end than at its first end.

Embodiment 9. The insulated building structure of embodiment 8, wherein the major top surface of each said shelf forms an angle to the plane up to 45 degrees, e.g., up to 30 degrees, or in the range of 5-45 degrees, or 15-45 degrees, or 5-30 degrees.

Embodiment 10. The insulated building structure of any of embodiments 1-9, comprising at least four shelves, e.g., at least six shelves or at least twelve shelves.

Embodiment 11. The insulated building structure of any of embodiments 1-10, wherein the one or more shelves include a first shelf and a second shelf positioned directly below the first shelf.

Embodiment 12. The insulated building structure of any of embodiments 1-11 wherein the one or more shelves include a first shelf and a second shelf, in which the first shelf has a first end adjacent to a first surface defining the cavity and a second end distal the first surface and spaced from a second surface opposite the first surface, and wherein the second shelf has a first end adjacent to the second surface and a second end distal the second surface and spaced from the first surface.

Embodiment 13. The insulated building structure of embodiment 12 wherein the first surface is the first lateral surface.

Embodiment 14. The insulated building structure of embodiment 12 wherein the first surface is the front panel or the back panel.

Embodiment 15. The insulated building structure of any of embodiments 1-14, wherein the back surface defining the cavity is provided by wallboard, lath and plaster, or sheathing, and the front panel defining the cavity is provided by a sheet of flexible material such as a fabric, mesh, or plastic sheet.

Embodiment 16. The insulated building structure of any of embodiments 1-15, wherein the cavity extends longitudinally (e.g., the studs are disposed) at an angle that is no more than 60 degrees from vertical, e.g., no more than 45 degrees from vertical.

Embodiment 17. The insulated building structure of any of embodiments 1-16, wherein each of the shelves has an occluded area of no more than 90% (e.g., no more than 80%, no more than 70%, no more than 60%, or no more than 50%) of the cross-sectional area of the cavity.

Embodiment 18. The insulated building structure of any of embodiments 1-17, wherein each of the shelves has an occluded area of at least 5% (e.g., at least 10%, at least 15%, or at least 20%) of the cross-sectional area of the cavity.

Embodiment 19. The insulated building structure of any of embodiments 1-18, wherein each of the shelves has an occluded area in the range of 5-90%, e.g., 5-80%, or 5-70%, or 5-60%, or 5-50%, or 10-90%, or 10-80%, or 10-70%, or 10-60%, or 10-50%, or 15-90%, or 15-80%, or 15-70%, or 15-60%, or 15-50%, or 15-90%, or 20-80%, or 20-70%, or 20-60%, or 20-50% of the cross-sectional area of the cavity.

Embodiment 20. The insulated building structure of any of embodiments 1-19, wherein an average insulation height in the longitudinal direction is no more than 4 feet, e.g., no more than 3 feet, or no more than 2 feet.

Embodiment 21. The insulated building structure of any of embodiments 1-20, wherein a maximum possible insulation height in the longitudinal direction is no more than 4 feet, e.g., no more than 3 feet, or no more than 2 feet.

Embodiment 22. The insulated building structure of any of embodiments 1-21, wherein the insulated building structure is prefabricated and is not installed as part of a building.

Embodiment 23. The insulated building structure of any of embodiments 1-22, wherein the insulation used to insulate the structure is an insulation that achieves a k-value of no more than 0.31 at a density of no less than 0.37 lbs per cubic foot, a k-value of no more than 0.29 at a density of no less than 0.6 lbs per cubic foot, a k-value of no more than 0.27 at a density of no less than 0.7 lbs per cubic foot, a k-value of no more than 0.26 at a density of no less than 0.8 lbs per cubic foot, a k-value of no more than 0.25 at a density of no less than 1.0 lbs per cubic foot, a k-value of no more than 0.24 at a density of no less than 1.2 lbs per cubic foot, and a k-value of no more than 0.23 at a density of no less than 1.3 lbs per cubic foot.

Embodiment 24. A method of insulating a building cavity (e.g., to form an insulated building cavity according to any of embodiments 1-23), the method comprising:

providing a building structure comprising:

a longitudinally-extending cavity bound by a first lateral surface, a second lateral surface, a back surface and a front surface, the cavity having a cross-sectional area in a plane normal to a longitudinal axis of the cavity;

one or more shelves extending into the cavity, each having an occluded area in the plane that is less than the cross-sectional area of the cavity; and disposing loose-fill insulation in the cavity such that loose-fill insulation is positioned above and below each of the shelves.

Embodiment 25. The method of embodiment 24, wherein the building structure is as described in any of embodiments 2-23.

Embodiment 26. The method of embodiment 24 or embodiment 25, wherein the loose-fill insulation is disposed in a cavity by being blown in.

Embodiment 27. The method of any of embodiments 24-26, wherein the insulation is introduced into the cavity at three or fewer locations.

Embodiment 28. The method of any of embodiments 24-27, wherein the building structure is not installed as part of a building when the loose-fill insulation is disposed therein.

Embodiment 29. The method of embodiment 28, wherein the building structure is disposed such that its longitudinally-extending direction is within 15 degrees of horizontal, e.g., within 5 degrees of horizontal when the loose-fill insulation is disposed therein.

Embodiment 30. The method of any of embodiment 28 or embodiment 29, wherein after the loose-fill insulation is disposed in the cavity, and then the building structure is moved to a building site and installed as part of a building.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. An insulated building structure comprising:

a longitudinally-extending cavity bound by a first lateral surface, a second lateral surface, a back surface and a front surface, the cavity having a cross-sectional area in a plane normal to a longitudinal axis of the cavity;

one or more shelves extending into the cavity, each having an occluded area in the plane that is 20-80% of the cross-sectional area of the cavity; and loose-fill insulation disposed in the cavity, the loose-fill insulation being positioned above and below each of the shelves, wherein each of the shelves supports at least part of the weight of the loose-fill insulation positioned directly thereabove, wherein one or more of the shelves has a first end adjacent the second lateral surface of the cavity and a second end distal the second lateral surface of the cavity and spaced from the first lateral surface of the cavity.

2. The insulated building structure of claim 1, wherein the building structure comprises:

a first stud defining the first lateral surface of the cavity;

a second stud spaced laterally from the first stud, the second stud defining the second lateral surface of the cavity;

a back panel extending between a back side of the first stud and a back side of the second stud, the back panel defining the back surface of the cavity; and a front panel extending between a front side of the first stud and a front side of the second stud, the front panel defining the front surface of the cavity.

3. The insulated building structure of claim 1 wherein one or more of the shelves is oblique to the plane such that a major top surface of the shelf is higher at its second end than at its first end, and wherein the major top surface of each said shelf forms an angle to the plane in the range of 5-45 degrees.

4. The insulated building structure of claim 1 wherein one or more or the shelves has a first end adjacent the back surface of the cavity and a second end distal the back surface of the cavity and spaced from the front surface of the cavity.

5. The insulated building structure of claim 1, comprising at least four shelves.

6. The insulated building structure of claim 1, wherein the back surface defining the cavity is provided by wallboard, lath and plaster, or sheathing, and the front surface defining the cavity is provided by a sheet of fabric, mesh, or plastic sheet.

7. The insulated building structure of claim 1, wherein the cavity extends longitudinally at an angle that is no more than 60 degrees from vertical.

8. The insulated building structure of claim 1, wherein each of the shelves has an occluded area of 20-50% of the cross-sectional area of the cavity.

9. The insulated building structure of claim 1, wherein the insulated building structure is prefabricated and is not installed as part of a building.

10. The insulated building structure of claim 1, wherein the one or more shelves comprise a plurality of shelves extending in an alternating fashion.

11. The insulated building structure of claim 1, wherein each of the one or more shelves has a depth that is at least 40% of the depth of the cavity, and/or a width that is at least 40% of the width of the cavity.

12. A method of insulating a building cavity to provide a building cavity according to claim 1, the method comprising:

providing a building structure comprising:

a longitudinally-extending cavity bound by a first lateral surface, a second lateral surface, a back surface and a front surface, the cavity having a cross-sectional area in a plane normal to a longitudinal axis of the cavity;

one or more shelves extending into the cavity, each having an occluded area in the plane that is 20-80% of the cross-sectional area of the cavity, wherein one or more of the shelves has a first end adjacent the second lateral surface of the cavity and a second end distal the second lateral surface of the cavity and spaced from the first lateral surface of the cavity; and blowing loose-fill insulation into the cavity such that loose-fill insulation is positioned above and below each of the shelves, wherein each of the shelves supports at least part of the weight of the loose-fill insulation positioned directly thereabove.

13. The method of claim 12, wherein the insulation is introduced into the cavity at three or fewer locations.

14. The method of claim 12, wherein the building structure is not installed as part of a building when the loose-fill insulation is disposed therein, and wherein the building structure is disposed such that its longitudinally-extending direction is within 15 degrees of horizontal when the loose-fill insulation is disposed therein.

15. The method of claim 12, wherein each of the one or more shelves has a depth that is at least 60% of the depth of the cavity, and/or a width that is at least 60% of the width of the cavity.

16. An insulated building structure comprising:

a longitudinally-extending cavity bound by a first lateral surface, a second lateral surface, a back surface and a front surface, the cavity having a cross-sectional area in a plane normal to a longitudinal axis of the cavity;

one or more shelves extending into the cavity, each having an occluded area in the plane that is 20-80% of the cross-sectional area of the cavity; and loose-fill insulation disposed in the cavity, the loose-fill insulation being positioned above and below each of the shelves, wherein each of the shelves supports at least part of the weight of the loose-fill insulation positioned directly thereabove, wherein the one or more shelves include a first shelf and a second shelf, in which the first shelf has a first end adjacent to a first surface defining the cavity and a second end distal the first surface and spaced from a second surface opposite the first surface, and wherein the second shelf has a first end adjacent to the second surface and a second end distal the second surface and spaced from the first surface, and wherein the first surface is the first lateral surface of the cavity and the second surface is the second lateral surface of the cavity, or the first surface is the second lateral surface of the cavity and the second surface is the first lateral surface of the cavity, or the first surface is the front surface of the cavity and the second surface is the back surface of the cavity, or the first surface is the back surface of the cavity and the second surface is the front surface of the cavity.

17. The insulated building structure of claim 16 wherein the first surface is the first lateral surface.

18. The insulated building structure of claim 16 wherein the first surface is the front surface or the back surface.

19. A method of insulating a building cavity to provide a building cavity according to claim 16, the method comprising:

providing a building structure comprising:

a longitudinally-extending cavity bound by a first lateral surface, a second lateral surface, a back surface and a front surface, the cavity having a cross-sectional area in a plane normal to a longitudinal axis of the cavity;

one or more shelves extending into the cavity, each having an occluded area in the plane that is 20-80% of the cross-sectional area of the , wherein the one or more of the shelves include a first shelf and a second shelf, in which the first shelf has a first end adjacent to a first surface defining the cavity and a second end distal the first surface and spaced from a second surface opposite the first surface, and wherein the second shelf has a first end adjacent to the second surface and a second end distal the second surface and spaced from the first surface, and wherein the first surface is the first lateral surface of the cavity and the second surface is the second lateral surface of the cavity, or the first surface is the second lateral surface of the cavity and the second surface is the first lateral surface of the cavity, or the first surface is the front surface of the cavity and the second surface is the back surface of cavity, or the first surface is the back surface of the cavity and the second surface is the front surface of the cavity; and blowing loose-fill insulation into the cavity such that loose-fill insulation is positioned above and below each of the shelves, wherein each of the shelves supports at least part of the weight of the loose-fill insulation positioned directly thereabove.

20. The insulated building structure of claim 16, wherein each of the one or more shelves has a depth that is at least 40% of the depth of the cavity, and/or a width that is at least 40% of the width of the cavity.

21. An insulated building structure comprising:

a longitudinally-extending cavity bound by a first lateral surface, a second lateral surface, a back surface and a front surface, the cavity having a cross-sectional area in a plane normal to a longitudinal axis of the cavity;

one or more shelves extending into the cavity, each having an occluded area in the plane that is 20-80% of the cross-sectional area of the cavity; and loose-fill insulation disposed in the cavity, the loose-fill insulation being positioned above and below each of the shelves, wherein each of the shelves supports at least part of the weight of the loose-fill insulation positioned directly thereabove, wherein one or more of the shelves has a first end adjacent the front surface of the cavity and a second end distal the front surface of the cavity and spaced from the back lateral surface of the cavity.

22. The insulated building structure of claim 21, wherein each of the one or more shelves has a depth that is at least 40% of the depth of the cavity, and/or a width that is at least 40% of the width of the cavity.

23. A method of insulating a building cavity to provide a building cavity according to claim 21, the method comprising:

providing a building structure comprising:

a longitudinally-extending cavity bound by a first lateral surface, a second lateral surface, a back surface and a front surface, the cavity having a cross-sectional area in a plane normal to a longitudinal axis of the cavity;

one or more shelves extending into the cavity, each having an occluded area in the plane that is 20-80% of the cross-sectional area of the cavity, wherein one or more of the shelves has a first end adjacent the front surface of the cavity and a second end distal the front surface of the cavity and spaced from the back lateral surface of the cavity; and blowing loose-fill insulation into the cavity such that loose-fill insulation is positioned above and below each of the shelves, wherein each of the shelves supports at least part of the weight of the loose-fill insulation positioned directly thereabove.

* * * * *